United States Patent [19]

Mackal

[11] Patent Number: 5,058,635

[45] Date of Patent: Oct. 22, 1991

[54] GAS CARTRIDGE INFLATOR HAVING HOLLOW PIN OF TRUNCATE EXTENT

[76] Inventor: Glenn H. Mackal, 4923 59th Ave., St. Petersburg, Fla. 33715

[21] Appl. No.: 523,154

[22] Filed: May 14, 1990

[51] Int. Cl.[5] ..... B63C 9/24

[52] U.S. Cl. ..... 141/329; 222/005; 141/19

[58] Field of Search ..... 141/329, 330, 17, 19; 222/80, 81, 5, 83, 83.5; 441/93, 94

[56] References Cited

U.S. PATENT DOCUMENTS

| | | | |
|---|---|---|---|
| 2,730,093 | 1/1956 | Neely | 141/19 X |
| 2,736,462 | 2/1956 | Manhartsberger | 141/19 X |
| 3,024,044 | 3/1962 | Benevento | 141/330 X |
| 3,091,365 | 5/1963 | Horner et al. | 222/5 |
| 3,169,665 | 2/1965 | Colley | 222/5 |
| 3,591,877 | 7/1971 | Schuler | 222/5 X |
| 3,809,288 | 5/1974 | Mackal | 222/5 |
| 3,815,783 | 6/1974 | Hirata | 222/5 |
| 3,997,079 | 12/1976 | Niemann | 222/5 |
| 4,223,805 | 9/1980 | Mackal | 222/5 |
| 4,267,944 | 5/1981 | Mackal | 222/5 |
| 4,489,855 | 12/1984 | Boetger | 222/5 |
| 4,498,605 | 2/1985 | Mackal et al. | 222/5 |
| 4,946,067 | 8/1990 | Kelsall | 222/5 |

FOREIGN PATENT DOCUMENTS

| | | | |
|---|---|---|---|
| 526679 | 6/1956 | Canada | 222/5 |
| 588284 | 12/1959 | Canada | 222/5 |
| 684309 | 4/1964 | Canada | 222/5 |

*Primary Examiner*—Ernest G. Cusick

*Attorney, Agent, or Firm*—Joseph C. Mason, Jr.; Ronald E. Smith

[57] ABSTRACT

A $CO_2$ cartridge is screw threadedly received into an inflator having a lanyard-operated, pivotally mounted bell crank. A pin having a round in section pointed end capable of puncturing the cartridge is slidably positioned within a bore formed in the inflator and the length of the pin exceeds the length of the bore so that the head of the pin protrudes out of the bore. Rocking the bell crank about its pivot point drives the head of the pin into the bore so that the pointed end of the pin punctures the thin center of the cartridge. The pin in hollow so that the gas escaping from the cartridge flows through the pin and is directed into another bore formed in the inflator which is confluent with the inflation manifold of an inflatable device.

9 Claims, 1 Drawing Sheet

GAS CARTRIDGE INFLATOR HAVING HOLLOW PIN OF TRUNCATE EXTENT

TECHNICAL FIELD

This invention relates to an improved gas cartridge inflator having a unique piercing pin disposed therewithin for inflating life vests, life rafts and the like.

BACKGROUND ART

Small cartridges that hold a large quantity of carbon dioxide or other gaseous fluid therein are well known. The cartridges are commonly used to rapidly inflate items that require rapid inflation, such as life vests and life rafts.

Numerous devices have been invented that have utility in rupturing or piercing the gas cartridge and directing the gas into the item to be inflated. For example, U.S. Pat. No. 3,911,762 to Mackal et. al. shows an apparatus where the cartridge is pierced by rotating a bell crank about a pivot shaft. The rotation of the lever causes a solid piercing pin to rupture the gas cartridge.

Another inflator that includes a cartridge piercing solid pin is shown in U.S. Pat. No. 3,809,288, also to Mackal et. al.

The pressure within a typical gas cartridge is above eight hundred pounds per square inch. Accordingly, even the end wall thereof that is pierceable is strongly reinforced about its periphery so that the only pierceable part thereof is a small, central target area which has a relatively thin construction. If a pin is slightly misaligned, it will miss the thin center and the cartridge will remain unpunctured. Prior art pins, in general, have been plagued by alignment problems.

Moreover, maximum flow of gas from the cartridges is obtained when the hole created by the piercing pin is round. Prior art pins are mostly of solid construction and typically produce crescent shaped or other non-round holes. Thus, the escaping gas flows, at an inhibited rate, past the solid pin in route to the interior cavity of the inflatable article.

One prior art pin is formed by bending a flat plate into a tubular configuration, thereby producing a longitudinally extending slot therein. However, that pin has a relatively weak, elongate construction and thus it is relatively unsupported at the base into which it is driven. Another drawback of that pin is its two piece construction.

There is a need, then, for a one piece, structurally sound cartridge piercing pin that is free from misalignment problems so that it consistently pierces the thin center of the cartridge. There is a need as well for a pin that produces round punctures to maximize gas flow from the pierced cartridge. There is also a need for a truncate pin having increased structural integrity. However, the prior art, taken as a whole, neither teaches nor suggests how an improved pin could be built.

DISCLOSURE OF INVENTION

The longstanding but heretofore unfulfilled need for an improved inflator and piercing pin is now provided in the form of an inflator having a highly novel pin that is slidably mounted in a first bore formed in the interior of the inflator. A second bore formed in the inflator screw threadedly receives a $C0_2$ capsule, and the first and second bores are in open fluid communication with one another.

The first bore has a longitudinal extent less than the longitudinal extent of the novel pin so that the head of the pin extends outwardly from the first bore when the pin is slidably received therein.

A generally "L"-shaped lever arm or bell crank is pivotally secured to the inflator and has a cam surface that rests atop the head of the novel hollow pin when the lever arm is unpivoted. When the bell crank is pivoted, the cam surface bears against the head of the pin and displaces the pin so that its cartridge-piercing end is driven into the thin center of the $C0_2$ cartridge positioned in the second bore, thereby puncturing it. A tubular part of the pin is hollow and accordingly directs the escaping gases through the truncate body of the pin into a third bore, also formed in the inflator, that is in open fluid communication with the inflation manifold of an article to be inflated.

It is a general object of this invention to provide an improved inflator apparatus that includes an improved cartridge-piercing pin.

More specific objects include the provision of a strong, one-piece truncate hollow pin that consistently produces round punctures in gas cartridges, that is free of misalignment problems, and that is easy to manufacture.

Additional objects and advantages will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
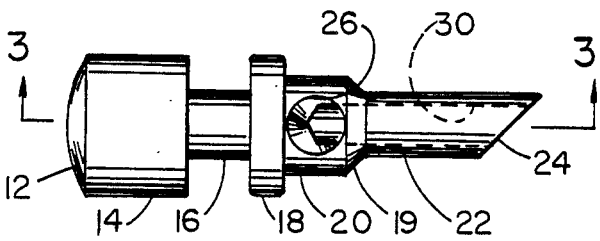
FIG. 1 is a side elevational view of an exemplary embodiment of the novel pin.
Figure 2:
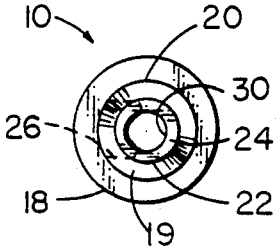
FIG. 2 is an end view thereof.

Referring now to FIG. 1, it will there be seen that the novel pin is denoted by the reference numeral 10 as a whole. Pin 10 includes a frusto-spherical head 12 having cylindrical side walls 14, a cylindrical neck 16 of reduced diameter and an annular guide ring 18 having the same diameter as head 12. Cylindrical boss member 20 is integral to guide ring 18 and projects distally therefrom as shown; boss 20 enables formation of a radial aperture in the pin as will become more clear as this description proceeds. It also supports the base of hollow tubular member 22, thereby enabling the shortening of said tubular member without adversely affecting its structural integrity. An annular bevel 19 reduces the diameter of the boss member 20 to the common diameter of neck 16 and hollow tubular member 22. Tubular member 22 has a wedge-shaped or cartridge-piercing pointed distal end 24. As shown in FIG. 2, end 24 is round when seen in end view.

Figure 3:
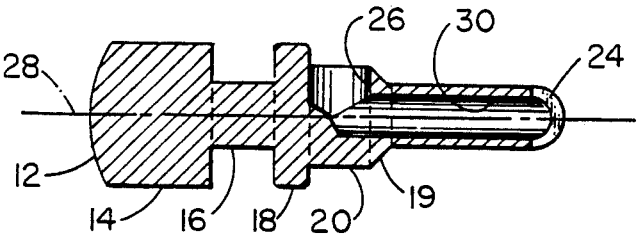
FIG. 3 is a sectional view taken along line 3—3 in FIG. 1.

Fluid passageway 26 extends radially outwardly with respect to the longitudinal axis 28 of pin 10 as perhaps best understood in connection with FIGS. 2 and 3 and longitudinally extending fluid passageway 30, defined by tubular member 22, provides fluid communication between passageway 26 and gaseous fluid from a pierced gas cartridge.

Figure 4:
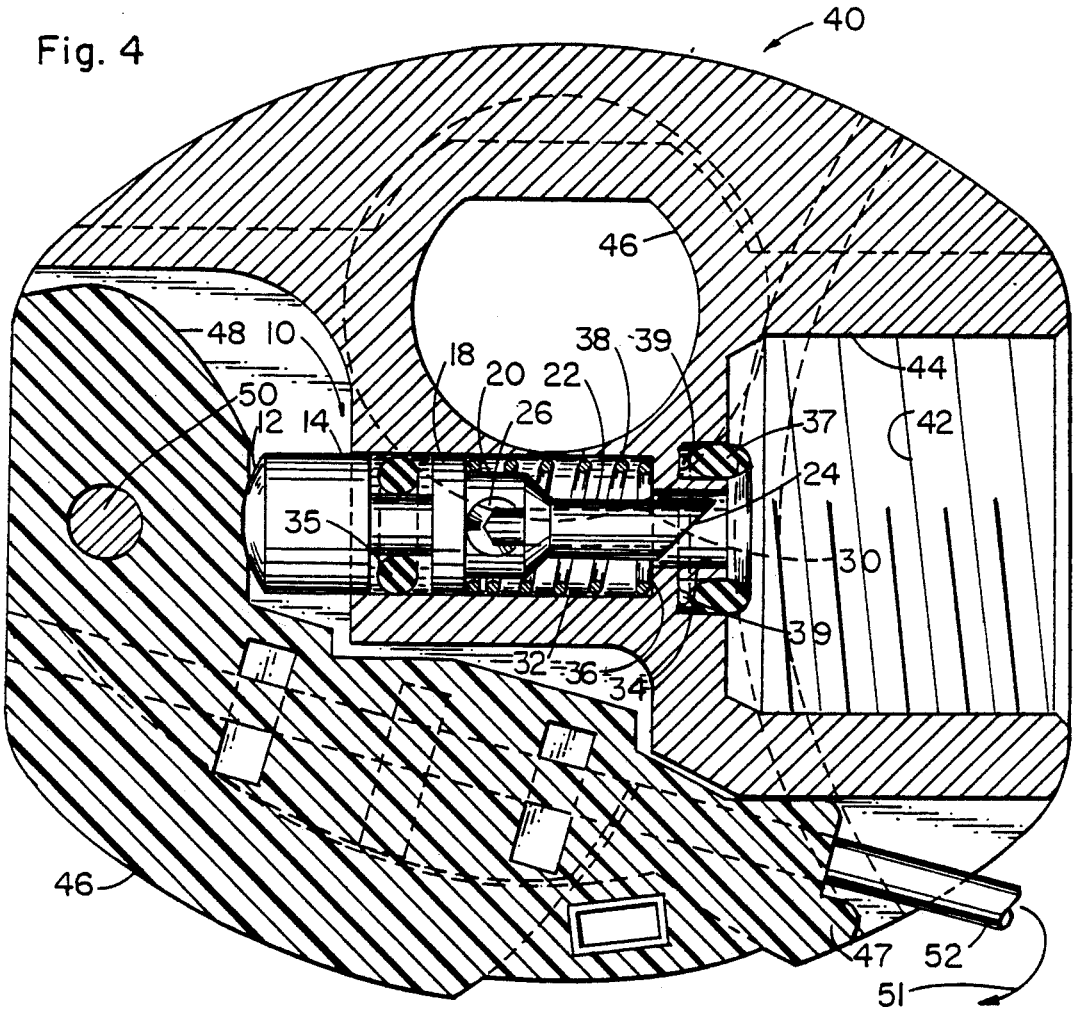
FIG. 4 is a sectional view of the novel inflator.

As shown in FIG. 4, pin 10 is initially placed in first bore 32 which is formed substantially centrally of substantially solid inflator 40. Head 12 and the guide ring 18 are of the same diameter and cooperate to maintain pin 10 in operable position within first bore 32. Note that the common diameter of head 14 and guide ring 18 are only slightly less than the diameter of bore 32, thereby ensuring the precise alignment of pin 10 in said bore. The distal end of tubular member 22 extends into a reduced diameter section 34 of the first bore, i.e., bore 34 is confluent with first bore 32. In the claims that follow, bore 34 is called the fourth bore. An annular shoulder 36 is defined where first and fourth bores 32 and 34 meet; the distal end of spring 38 is supported by said shoulder 36. "O" rings 35 and 37 are also provided. Bore 34 is also confluent with second bore 44 which is internally threaded as at 42 and which screw threadedly receives a pressurized gas cartridge such as a $CO_2$ cartridge (not shown). Note that piercing end 24 of pin 10 is precisely centered with respect to bore 44, thereby ensuring that the thin center of a cartridge positioned therein will be punctured when the piercing end 24 is driven into said cartridge. Bore 44 has an outer end flush with the surface of inflator 40 as shown, i.e., said outer end of bore 44 is in open fluid communication with the external environment or ambient.

The longitudinal extent of pin 10 exceeds the longitudinal extent of first bore 32; accordingly, a substantial part of head 12 protrudes proximally therefrom as shown.

Lever arm or bell crank 46 has cam surface 48 that abuttingly engages head 12 when said bell crank is in its equilibrium position as depicted; spring 38 serves to maintain it in said position. Crank 46 is pivotally mounted about pivot shaft 50 so that rotation of lever arm 46 about said axis 50 (by pulling on lanyard 52 in the direction of arrow 51) drives head 12 into bore 32, as those skilled in the mechanical arts will readily appreciate upon inspection of FIG. 4. The cam surface 48 serves as a driving means for driving pin 10 into the gas cartridge. It should be observed that pivot shaft 50 is in longitudinal alignment with the axis of symmetry of the first and second bores, 32 and 44, which axis is the longitudinal axis of symmetry of inflator 40. It should also be observed that hump 47 of crank 46 (lower right corner of FIG. 4) ensures that lanyard 52 will execute a gentle return bend when pulled in the direction of arrow 51, i.e., a sharp, abrading bend of lanyard 52 is eliminated by said hump 47.

Since pin 10 is an integral unit, displacement of head 12 drives tubular member 22 and its pointed end 24 into second bore 44 and into rupturing engagement with the thin center of a gas cartridge that might be situated therein, forming a round hole for the escape of gases therethrough. All gas exiting the ruptured cartridge may flow through the passageways 30 and 26 that are formed in tubular member 22 and boss 20, respectively, said flow including a ninety degree bend. Passageway 26 is confluent with third bore 46 (FIG. 4) which in turn is in fluid communication with an inflation manifold of any inflatable device so that the gas exiting the cartridge rapidly inflates such device.

The longitudinal extent of tubular member 22 is less than that of the corresponding part of the piercing pins of the prior art because boss 20 supports the base of tubular member 22. Thus, if boss 20 were not employed, tubular member 22 would have a greater longitudinal extent, i.e., it would be supported at its base by guide ring 18 and would have less structural integrity. Such boss-less construction is typical of prior art pins, and said pins often fail by breaking off at their base.

A hollow pin requires a radial bore to allow gases to be routed to the inflation manifold, not shown, positioned in D-shaped bore 46, i.e., the provision of longitudinally extending passageway 30 requires the provision of radial passageway 26. Hollow piercing pins were not heretofore contemplated by those of ordinary skill in the art because a hollow pin of predetermined diameter would require a radial bore of substantially equal diameter, as those skilled in the science of fluid mechanics will appreciate, and a tube having a radial bore formed therein of diameter equal to that of the tube cannot be formed without adversely affecting the structural integrity of the tube, as those skilled in the mechanical arts will appreciate.

The present inventor overcomes this apparent limitation to the development of hollow pins by providing boss 20. Boss 20, in effect, increases the diameter of tubular member 22 so that radial bore 26 can be formed therein without destroying the tubular member. As mentioned earlier, boss 20 also enables the shortening of tubular member 22 and enhances its structural integrity.

"O" ring 37 and its retaining groove are also unique; note the oval configuration of the "O" ring and the convex protuberance 39 that circumscribes the retaining groove, said protuberance being formed in a bottom wall of said groove and said protuberance serving to prevent facile deformation and flattening of "O" ring 37. As shown, the retaining groove is concentric with fourth bore 34.

Thus, the inflator and pin are characterized by structural simplicity, yet the apparatus performs its intended function even more capably than the more complex structures of the prior art. Just as importantly, this invention breaks new ground with its disclosure of a hollow piercing pin of truncate extent that is free of alignment problems and that has a means for forming a radial bore therein without structurally weakening the pin.

Clearly, the invention is new and useful. Moreover, it was not obvious to those of ordinary skill in the art at the time it was made, in view of the prior art, considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for quickly introducing gaseous fluid into the inflation manifold of an inflatable device, said apparatus including an inflator adapted to receive a gas cartridge, and said apparatus further including a means for puncturing the gas cartridge when a lanyard is pulled, comprising:

a first bore, having a first predetermined diameter, formed in said inflator, substantially centrally thereof;

a second bore formed in said inflator, said second bore having a second predetermined diameter greater than said first predetermined diameter, said second bore having a first, inner end in open fluid communication with said first bore and a second, outer end in open communication with an external surface of said inflator so that said gas cartridge is insertable into said second bore;

a pin member slidably disposed within said first bore;

said pin member having a head at a first end thereof;

said pin member having a tubular member, adapted to pierce said gas cartridge, at a second end thereof;

said pin member having a longitudinal extent greater than the longitudinal extent of said first bore and said head protruding at least partially out of said first bore when said pin member is disposed in said first bore;

driving means for driving said head of said pin member into said first bore and thereby driving said pointed second end of said pin member into said second bore so that said gas cartridge disposed within said second bore is punctured;

a fluid passageway being formed internally of said pin member;

a third bore formed in said inflator;

said third bore being confluent with said first bore and being confluent with said inflation manifold of said inflatable device;

said driving means being a bell crank pivotally connected to said inflator, said bell crank having a first part adapted to abuttingly engage said head of said pin member when said head is protruding from said first bore and when said bell crank is in an equilibrium position;

a pivot shaft about which said bell crank pivots;

said pivot shaft being positioned in longitudinal alignment with said first and second bores;

said pin member having a diameter only slightly less than the first predetermined diameter of said first bore;

said tubular member being round in section to produce a round hole in said cartridge;

said tubular member being of reduced predetermined diameter relative to said head;

a fourth bore, of predetermined diameter less than said first predetermined diameter, that slidably receives said tubular member, said fourth bore being confluent with said second bore inner end;

an annular shoulder formed where said first bore and said fourth bore meet;

said pin member further including a boss member;

said boss member having a diameter greater than the predetermined diameter of said tubular member and less than the diameter of said head;

said boss member supporting a base part of said tubular member to enhance the structural integrity of said pin member; and said fluid passageway formed internally of said pin member including a longitudinally extending first part defined by said tubular member and a radially extending second part formed in said boss member so that gaseous fluid exiting said gas cartridge follows a path of travel into said inflatable device that includes a ninety degree bend;

whereby gas escaping from said punctured gas cartridge enters into said fluid passageway formed in said pin member and thence into said third bore and thence into the inflatable device.

2. The apparatus of claim 1, further comprising a guide ring having a diameter equal to the diameter of said head, said guide ring being longitudinally spaced from said head, and a neck of reduced diameter disposed in interconnecting relation to said head and guide ring, said guide ring and said head cooperating to maintain said pin in centered alignment relative to said first bore so that said tubular member pierces a thin center of said cartridge when said pin member is activated by said bell crank.

3. The apparatus of claim 2, further comprising a bias means disposed in said first bore between said guide ring and said annular shoulder.

4. The apparatus of claim 3, further comprising a sealing means disposed in said first bore between said head and said guide ring.

5. The apparatus of claim 4, further comprising an annular groove formed in said inner end of said second bore in concentric relation to said fourth bore and an "O" ring member being disposed in said annular groove, said member protruding at least partially from said annular groove into said second bore.

6. The apparatus of claim 5, wherein said an "O" ring member disposed in said annular groove is an oval, in section, "O" ring member and wherein an annular protuberance is formed in a bottom wall of said annular groove to defeat facile distortion of said oval in section "O" ring.

7. The apparatus of claim 1, further comprising a hump formed in said bell crank at a base thereof to protect from abrasion said lanyard when said lanyard is pulled to rotate said bell crank about said pivot shaft.

8. A pin for use in an inflator for puncturing a gas cartridge, comprising:

a cylindrical head member;

a cylindrical boss member of predetermined diameter;

a neck member interconnecting said head and boss members;

A tubular member of predetermined diameter extending longitudinally from said boss member;

said boss member having a predetermined diameter greater than the predetermined diameter of said tubular member;

said tubular member having a round in section distal free end adapted to pierce said gas cartridge;

a first, longitudinally extending fluid passageway being formed along the entire extent of said tubular member;

a second, radially extending fluid passageway formed in said boss member;

said first and second fluid passageways being in open fluid communication with one another and being disposed normal to one another;

whereby gas exiting said gas cartridge pierced by said tubular member flows through said first and second fluid passageways and executes a ninety degree bend where said first and second fluid passageways meet.

9. The pin of claim 8, further comprising a guide ring member contiguous to said boss member, said guide ring member having a diameter equal to a diameter of said head member, and a sealing means being disposed between said head member and guide ring member in circumscribing relation to said neck member.

* * * * *